United States Patent [19]

Stelzer

[11] 4,018,024

[45] Apr. 19, 1977

[54] LOUVERED WINDOWS COMPRISING INSULATING PAIRS OF SUPERIMPOSED PANES

[76] Inventor: William Stelzer, 1354 Blue Heron Drive, Milford, Mich. 48042

[22] Filed: Sept. 22, 1975

[21] Appl. No.: 615,540

[52] U.S. Cl. ..... 52/473; 52/616

[51] Int. Cl.[2] ..... E06B 7/08

[58] Field of Search ..... 52/74, 78, 473, 616; 126/270; 49/74; 160/91, 92

[56] References Cited

UNITED STATES PATENTS

| | | | |
|---|---|---|---|
| 583,594 | 6/1897 | Ewen | 126/270 X |
| 1,639,474 | 8/1927 | Whitmore | 49/74 |
| 2,849,762 | 9/1958 | McCarthy | 52/473 |
| 2,929,446 | 3/1960 | Kuehnlein | 160/91 |
| 3,001,331 | 9/1961 | Brunton | 126/270 X |
| 3,012,605 | 12/1961 | Turk | 160/91 |
| 3,022,549 | 2/1962 | Cummings | 52/473 X |
| 3,047,913 | 8/1962 | Cooks | 160/91 X |
| 3,060,529 | 10/1962 | Clay | 49/74 X |
| 3,220,465 | 11/1965 | Leiser | 160/92 |
| 3,791,280 | 2/1974 | Williamson | 98/121 A |

FOREIGN PATENTS OR APPLICATIONS

| | | | |
|---|---|---|---|
| 2,033,924 | 1/1971 | Germany | 52/473 |
| 16,568 | 8/1897 | United Kingdom | 52/616 |

*Primary Examiner*—Price C. Faw, Jr.
*Assistant Examiner*—Leslie Braun

[57] ABSTRACT

A louvered hot and cold insulating window for admitting light to a building, characterized by the use of at least one pair of horizontally level superposed transparent panes sealingly held in spaced relationship to contain a layer of still air to serve as a heat and cold insulator, and structural means including light reflecting louvers arranged to sealingly support said transparent panes and to form a sash that can be selectively inserted in the walls of a building where in one position for use in cold weather the top of said pair of panes is facing the inside of said building and the underside is exposed to the outside of said building, and in a reversed position for use in hot weather said top is exposed to the outside of said building and said underside faces the inside of said building.

1 Claim, 6 Drawing Figures

LOUVERED WINDOWS COMPRISING INSULATING PAIRS OF SUPERIMPOSED PANES

Figure 1:
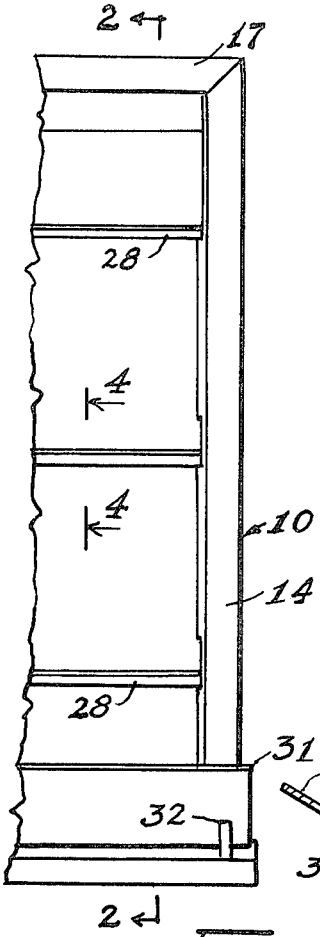

The invention relates to louvered windows for use in a building and in particular to a louvered window having at least one pair of horizontally level transparent panes spaced one above the other to provide an air space between them, and a supporting structure arranged to reflect light from the outside of the building to the inside.

Present windows having vertical double panes of glass have the disadvantage of heat loss due to convection, as the air between the panes is free to circulate and thereby transmit the heat from one pane to the other.

The object of the invention is to produce a louvered window comprising at least one pair of horizontally level panes of glass or other transparent material spaced to contain a layer of air so that no convection is produced and the heat loss is reduced to a minimum, as still air is an excellent insulator against heat or cold.

Another object is to provide light reflecting surfaces to reflect light through the level panes from the outside to the inside of the building where the louvered window is used.

Another object is to provide structural members to support the light transmitting panes, such structural members cooperating to reflect light to the inside of the building through the light transmitting panes.

A further object is to combine the horizontally level panes of glass and the supporting structural members as an easily installable unit that can be readily reversed in use so that in cold weather the air above the light transmitting panes is inside the building and the air below the light transmitting panes is outside the building, and in hot weather the air above the panes is outside and the air below is inside.

The invention also aims to conserve energy by conducting light into a building without excessive heat losses normally encountered in conventional windows.

Figure 2:
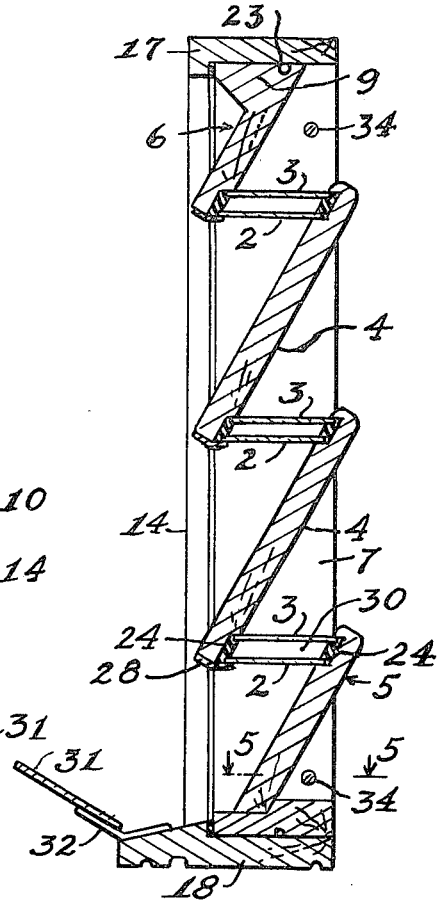
Figure 3:
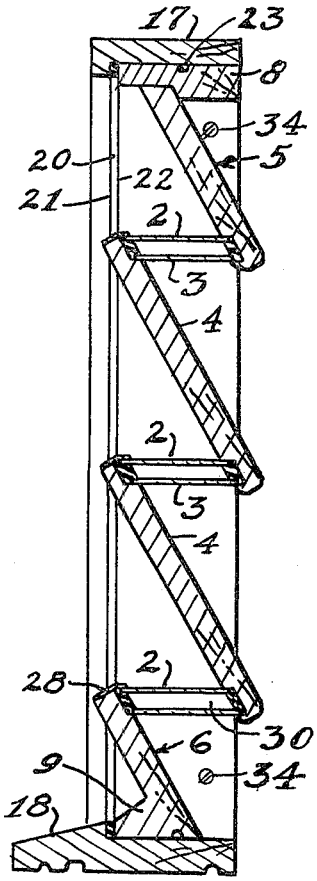
Figure 4:
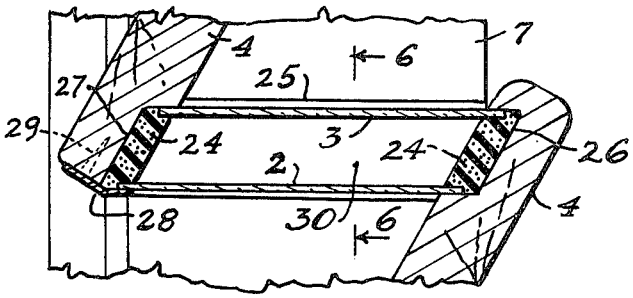
Figure 5:
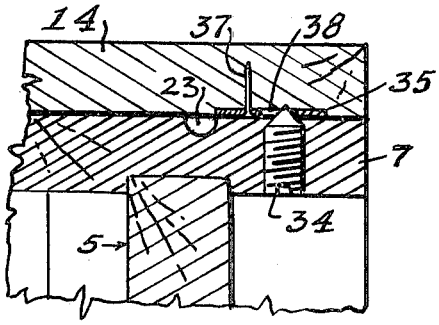
Figure 6:
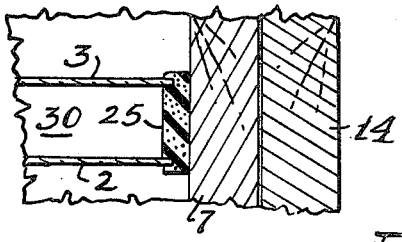

Other objects and advantages of the present invention will become more apparent from the following detailed description taken in conjunction with the drawing, in which:

FIG. 1 is a fragmentary front elevation of a louvered window incorporating the invention;

FIG. 2, a section taken on lines 2—2 of FIG. 1;

FIG. 3, a similar section but showing the unit reversed for use in a hot climate;

FIG. 4, a fragmentary section taken on lines 4—4 of FIG. 1, shown on a larger scale;

FIG. 5, a fragmentary section taken on lines 5—5 of FIG. 2, shown on a larger scale; and FIG. 6, a fragmentary section taken on lines 6—6 of FIG. 4.

Referring now to the drawing, the louvered window has at least one pair of light transmitting panes 2 and 3. The example shows three such pairs supported by structural cross-members or louvers 4, 5, and 6 secured at their ends to stiles 7. Louvers 5 and 6 are reinforced by crossrails 8 and 9, respectively, so that the cross-members and stiles form a rigid sash which fits into a frame 10. The latter is composed of vertical side jambs 14, head jamb 17, and sill 18 secured together, as for instance by bonding. A resilient seal 20 of sponge rubber or other suitable material between the face 21 of the frame 10 and the face 22 of the sash serves as a weather strip. There are also grooves 23 in the sash which may be filled with felt to provide an additional seal. The light transmitting panes 2 and 3 are spaced by seals 24 and 25 which may be molded of sponge rubber or similar elastomeric material having good heat insulating qualities. The cross-members have recesses 26 and 27 into which the seals fit, and these recesses also serve to keep the panes in place. The seals in the recesses 27 at the outside edges of the cross-members are retained by metal moldings 28 secured to the cross-members in a convenient manner, as by screws 29. The air space 30 between the panes serves as a heat insulator, as warm air stays on top and cold air remains equally stationary near the bottom pane. This is the most important part of the invention and the design shown utilizes this criterion to obtain a novel window having better heat insulating qualities. To admit as much light as possible through the light transmitting panes, the cross-members 4, 5, and 6 have light reflecting surfaces. If the cross-members are made of wood, the surfaces may be painted or enamelled white or silver, and if they are made of another material or a combination of different materials, the light reflective qualities may be inherent in the material used so that no additional coating or finishing is required. If the window is used to keep out the cold, an additional reflective surface may be used to improve the indirect lighting; in the example shown it is in the form of a light reflecting panel 31 secured to the sill 18 by means of brackets 32. The sill 18 also is light reflective on the top surface and it can be made wider to be more effective. The reflector or panel 31 is shown merely to illustrate the principle, if there are large light reflective surfaces below the window as part of the architecture of the building, panel 31 may be dispensed with. The sash should fit loosely in the vertical frame 10 so it can readily be installed into or removed from the frame. To hold the sash in place, set screws 34 are threaded in stiles 7 and engage plates 35, each fitting in a round recess in jamb 14, and secured by a nail or screw 37. Each plate has a hole 38 off-center from screw 34 so that the side of the screw engages the side of the hole in the plate. Thus by tightening the screws the sash is not only retained in the frame, it is also pressed against the seals 20.

The sash can be readily removed from the frame 10 by loosening the set screws 34. It can be inserted in the frame upside down. In cold weather when cold must be kept out the sash is installed as shown in FIG. 2 where the underside of the pair of panes is exposed to the outside and the top is in touch with the air inside the building. In hot weather or in hot climates when air conditioning is needed, the sash is reversed to be upside down, as shown in FIG. 3. In this position the hot outside air is in contact with the top of the pair of panes and the cool air inside the building is in contact with the underside of the pair of panes. Since the hot air is on top, the air in the space 30 is stationary and there is no loss of cooling due to convection. In this position the light is from above and therefore in this case the reflector 31 is not needed. When the sash is installed as shown in FIG. 2, suitable for cold weather, the lighting is indirect and its effectiveness depends mainly on the reflective surfaces.

Though in the description it has been pointed out that the panes must be horizontally level, it should be understood that a slight tilting out of the level plane could be tolerated, as a slight deviation would merely reduce the thickness of the layer of insulating air between the cooperating panes so that insulation would be less effective without losing its function entirely. It is obvious that the louvered sash incorporating the invention could be a part of a conventional window that permits opening for ventilating, but such applications are well known in the art and it would serve no purpose to go into such details.

In the description of the invention and in the claims, the expression "horizontally level" is intended to describe a plane or planes at right angles to a vertical line, or at right angle to a line in whose direction the force of the earth's gravity acts. Thus the top surface of a liquid in a standing vessel would be horizontally level.

While it is apparent that the embodiment of the invention shown is calculated to fulfill the objects above stated, it will be appreciated that the invention is susceptible to modification, variation, and change without departing from the proper scope or fair meaning of the invention.

I claim:

1. A window for admitting light to a building, comprising pairs of horizontally level superposed transparent panes sealingly held in spaced relationship to contain a layer of still air to serve as a heat and cold insulator, each of said pairs consisting of an upper pane and a lower pane, said panes being disposed at right angle to the force of gravity to prevent heat convection in said still air, structural means to support said pairs of transparent panes, said structural means and said transparent panes composing a sash as a self-contained unit, and a window frame, said sash being adapted to fit into said window frame to be easily removed from said window frame and selectively reinserted into said window frame in a reversed position so that for use in cold weather said upper pane in a pair of panes is exposed to the inside of said building and said lower pane is exposed to the outside of said building, and that for use in hot weather said upper pane is exposed to the outside of said building and said lower pane to the inside of said building, said structural means comprising cross-members extending longitudinally parallel with said panes to form louvers, each of said cross-members having an outside edge and an inside edge, each of said pairs of panes being disposed between said outside edge of one of said cross-members and said inside edge of the next one of said cross-members, said pairs of panes being sealingly supported by said cross-members.

* * * * *